United States Patent [19]

Paolino

[11] 4,043,174

[45] Aug. 23, 1977

[54] WIRE CONNECTOR CRIMPING DEVICE

[75] Inventor: Angelo J. Paolino, Waterbury, Conn.

[73] Assignee: American Eyelet Co. Inc., Waterbury, Conn.

[21] Appl. No.: 726,581

[22] Filed: Sept. 27, 1976

[51] Int. Cl.[2] ..... B21D 9/08

[52] U.S. Cl. ..... 72/412; 72/410; 72/472; 29/751; 140/106

[58] Field of Search ..... 140/106, 111, 113, 117; 29/751, 753; 81/9.1, 304, 9.3, 305; 72/384, 385, 410, 412, 416, 472, 477

[56] References Cited

U.S. PATENT DOCUMENTS

| | | | |
|---|---|---|---|
| 354,313 | 12/1886 | Galloway | 81/304 |
| 855,741 | 6/1907 | Albert | 140/117 |
| 1,289,380 | 12/1918 | Brumfield | 140/111 |
| 2,457,538 | 12/1948 | Dupre | 140/111 |
| 2,774,269 | 12/1956 | Demler et al. | 140/117 |
| 3,263,479 | 8/1966 | Johnson | 72/416 |
| 3,406,558 | 10/1968 | Tillmann et al. | 29/751 |
| 3,692,069 | 9/1972 | Clendennen et al. | 140/106 |
| 3,791,189 | 2/1974 | Lawson | 72/410 |

FOREIGN PATENT DOCUMENTS

| | | | |
|---|---|---|---|
| 1,112,772 | 8/1961 | Germany | 72/410 |
| 395,278 | 7/1933 | United Kingdom | 81/305 |

*Primary Examiner*—Lowell A. Larson
*Attorney, Agent, or Firm*—Robert K. Youtie

[57] ABSTRACT

A wire connector crimping device including a base having a generally flat underside and provided on its upperside with a plurality of receivers for conformably receiving different size wire connectors to be crimped, a rocker pivotally mounted over the base and having a plurality of crimping formations for crimping relation with respective receivers, and limit means limiting the crimping formations to movement into their crimping relation with respective receivers.

9 Claims, 4 Drawing Figures

FIG. 1
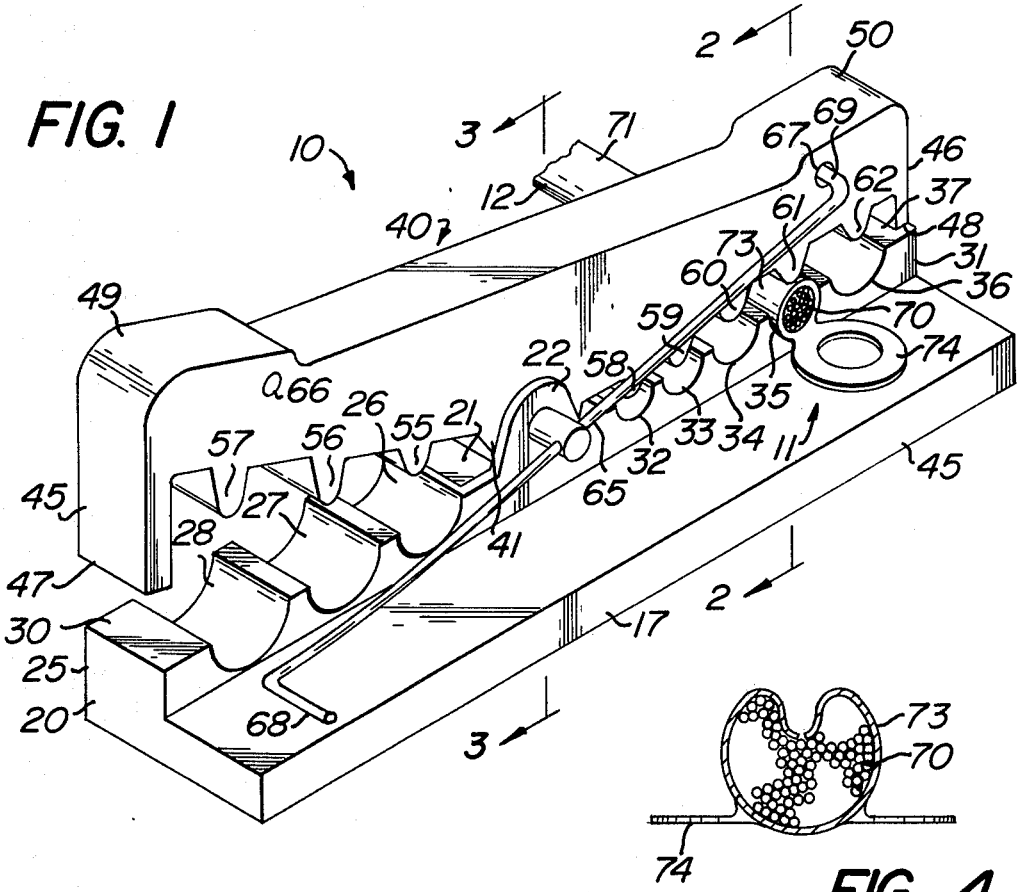
FIG. 4
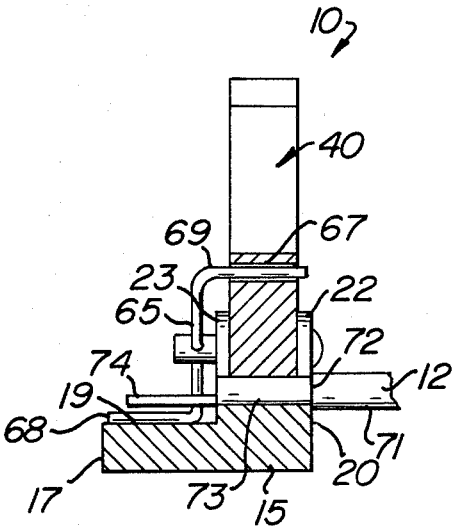
FIG. 2
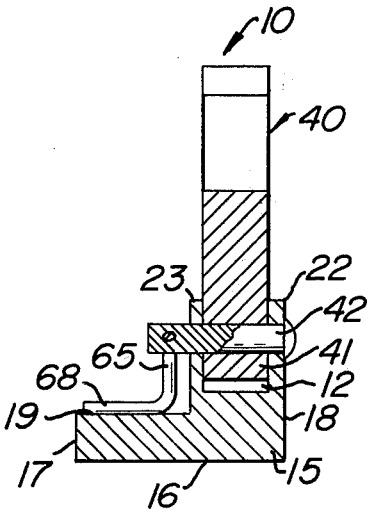
FIG. 3

WIRE CONNECTOR CRIMPING DEVICE

BACKGROUND OF THE INVENTION

While there are, in the prior art, a plurality of wire connector crimping devices, such devices are not entirely satisfactory. For example, prior art devices are difficult to use in locating and retaining the connector in position prior to squeezing, lacking in the ability to optimally crimp a wide variety of connector sizes, being difficult to properly orient the connector crimping, and presenting difficulty in removing crimped connectors.

SUMMARY OF THE INVENTION

Accordingly, it is an important object of the present invention to provide a wire connector crimping device which overcomes the above-mentioned difficulties, is extremely quick and easy to operate, wherein a wide variety of connectors are self-orienting in proper crimp location and self-retaining prior to actual crimping, is capable of great versatility for use with a wide variety of connector sizes, assures repeatable optimal crimping action, and enables quick and easy removal of crimped connectors from the tool.

It is still another object of the present invention to provide a wire connector crimping device having the advantageous characteristics mentioned in the preceding paragraph, which is extremely simple in construction, light in weight and compact in design, while being staunch and durable for entirely reliable operation throughout a long useful life.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a crimping device of the present invention in operative relation with a wire connector.

FIG. 2 is a sectional view taken generally along the line 2—2 of FIG. 1.

FIG. 3 is a sectional view taken generally along the line 3—3 of FIG. 1.

FIG. 4 is a sectional view taken generally along the line 4—4 of FIG. 1.

DESCRIPTION OF THE PREFERRED EMBODIMENT

Referring now more particularly to the drawings, and specifically to FIG. 1 thereof, a crimping device is there generally designated 10, and is shown in operative association with a connector 11 being crimped onto a wire 12.

The crimping device 10 may include an elongate, generally straight base 15 having a generally flat under surface 16. The base 15 is of substantial width, as between generally parallel side edges 17 and 18. Extending longitudinally of the base 15, on the upper base surface 19, generally along and flush with the base side edge 18 is an upstanding wall 20. The wall 20 is longitudinally coextensive with the base 15 and provided medially between its ends with an upwardly facing recess 21.

On opposite sides of the recess 21 in wall 20, there are a pair of laterally spaced upstanding journal lugs or stanchions 22 and 23.

The upstanding longitudinal wall 20 is further formed, between the medial recess 21 and one end 25 of the wall with a series or row of generally partial cylindrical upwardly facing cavities, grooves or receivers 26, 27 and 28. The receivers, grooves or troughs 26–28 are arranged in a row or series longitudinally of the wall 20, but each extend transversely of the wall, opening through opposite sides of the wall, and are successively of larger radii of curvature in the direction from medial recess 21 toward wall end 25. The endmost groove or receiver 28 is spaced from the wall end 25 to leave therebetween a generally flat, substantially horizontal upwardly facing abutment surface 30, for a purpose appearing presently.

Between the medial wall recess 21 and the opposite wall end 31, there are similarly provided a longitudinal series or row of partial cylindrical upwardly facing troughs, grooves or receivers 32, 33, 34, 35 and 36. The several troughs or receivers 32–36 are in side-by-side relation with each other, in the same manner as the first described receivers 26, 28, and extend transversely of the wall 20, opening through opposite sides thereof. Also, the several receivers 32–36 are of increasing radii in the direction between recess 21 and wall end 31, the endmost receiver 36 being spaced from wall end 31 to leave therebetween a generally flat, horizontal, upwardly facing abutment surface 37.

Arranged longitudinally of and over the wall 20 is an elongate rocker or lever, generally designated 40. The rocker is generally longitudinally coextensive with the base 15 and wall 20, and includes a depending protrusion 41 on its underside, spaced medially of the rocker and depending into recess 21. The medial depending protrusion 41 is interposed between lugs 22 and 23, and a journal pin or pivot 42 extends through both lugs 22 and 23 and the intermediate depending protrusion 41. In this manner, the lever or rocker 40 is mounted for rocking movement about the axis of pivot pin 42, relative to base 15 and wall 20.

At opposite ends of the rocker 40, there are provided respective depending abutment elements or stops 45 and 46. That is, a depending abutment element or stop 45 is provided on the end of rocker arm 40 proximate to end 25 of wall 20 over abutment surface 30. The stop member 45 depends to an end surface 47 which is movable into limiting abutting engagement with surface 30 and combines with the latter to define stop means for limiting rocker movement in one direction of its oscillation.

The opposite rocker end carries depending stop member 46 which terminates at its end in a downwardly facing surface 48 movable into limiting abutting engagement with the wall surface 37 to limit rocker arm movement in the opposite direction.

Upstanding from the rocker arm 40, proximate to the stop member 45 is an upper protrusion 49, and a similar upper protrusion 50 is provided on the opposite end of rocker arm 40 adjacent to stop member 46. By means of protrusion 49, a compressive force, as by clamping in a vice, impact or otherwise, may be transmitted through protrusion 49 to the flat undersurface 16 of base 15 in substantially direct alignment through engaging stop surfaces 47 and 30. At the other end of the crimping device 10, the protrusion 50 similarly provides means for applying a compressive force substantially directly through contacting stop surfaces 37 and 48 to the base underside 16. By this arrangement, the structural size and strength of the crimping device may be minimized for effective savings.

The underside of rocker arm 40 between depending protrusion 41 and stop member 45 is provided with a series or a row of depending protrusions, lugs or crimping formations, as at 55, 56 and 57. The crimping formations 55–57 are each located to swing with rocket 40 into generally concentric relation with respect to the receivers 26, 27 and 28, respectively. These crimping formations 55–57 are specifically configured so as to achieve an optimal crimp with an appropriately sized connector in the respective receiver when the stop surfaces 47 and 30 are in abutment.

Similarly, the underside of rocker arm 40 is provided between protrusion 41 and stop member 46 with a plurality of spaced, depending protrusions or crimping formations 58, 59, 60, 61 and 62, which crimping formations are respectively associated with receivers 32–36 in essentially the same manner as the hereinbefore described crimping formations 55–57 and receivers 26–28.

In addition, resilient means, say in the form of a resilient wire 65, may extend generally chordally through an extension of pivot pin 42, and oppositely therefrom toward opposite ends of the base 15. Adjacent to opposite ends of the rocker 40, as in upper regions thereof, the rocker may be provided with a pair of side opening bores or holes 66 and 67, and spring 65 may have angulate or transverse end portions 68 and 69 selectively engageable in respective holes 66 and 67. Thus, in the illustrated embodiment the spring wire end portion 68 is engaged in hole 66, and the spring wire end portion 69 bears on base 15 to urge the rocker 40 generally clockwise, as seen in FIG. 1. This direction of resilient biasing will assure that the connector 11 is held in the crimping device 10 without falling out under various conditions of handling. Should it be desired to hold a connector in one of the smaller receivers 32–36, the resilient spring wire 65 would have its transverse end 68 withdrawn from hole 66, be rotated approximately 180° about the longitudinal axis of the spring wire, and the transverse end 69 engaged in rocker hole 67 with the opposite wire end bearing on base 15.

From the drawing it will be appreciated that the wire 12 may be conventional, including a conductive core 70 and insulation sheath 71, the latter being stripped and removed beyond the insulation end edge 72. The connector 11 is located with its barrel 73 in the appropriate receiver 28, being properly oriented by abutting the insulation end 72 against the side surface of wall 20. In this condition, the connector head or eye 74 will be located over and effectively protected from dislodgement by the lateral extension of base 15.

It will now be appreciated that the present invention provides a wire connector crimping device which affords great versatility in use with a wide variety of connector sizes, assures optimal crimping of wall received connector sizes, effectively self-orients the connector prior to crimping and is self-retaining in the properly oriented position, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A wire connector crimping device for crimping a plurality of connector sizes, said device comprising an elongate base having a generally flat underside, a plurality of connector receivers disposed in side-by-side upwardly facing relation on said base and each extending generally transversely of said base, a rocker pivotally mounted intermediate its ends on said base and extending over said receivers for swinging movement of opposite rocker ends portions toward and away from respective receivers, stop means on said base and rocker to limit said swinging movement in opposite directions, a plurality of crimping formations depending from said rocker for movement into and out of crimping relation with respective receivers, for optimal crimping of a connector on a wire by placement in an appropriate receiver and swinging the rocker to move the appropriate crimping formation into its crimping relation.

2. A wire connector crimping device according to claim 1, said receivers each being generally semicylindrical, and said crimping formations comprising a series of teeth respectively movable centrally toward and away from said receivers.

3. A wire connector crimping device according to claim 1, said stop means comprising complementary pairs of abutment elements spaced on opposite sides of the rocker pivot.

4. A wire connector crimping device according to claim 1, in combination with a pair of protrusions upstanding from said rocker spaced on opposite sides of said rocker pivot for respective cooperation with the underside of said base to be selectively squeezed together between compressing forces.

5. A wire connector crimping device according to claim 1, in combination with resilient means yieldably urging said rocker in a selected direction of swinging movement to releasably retain a connector in a receiver.

6. A wire connector crimping device according to claim 5, said stop means comprising complementary pairs of abutment elements spaced on opposite sides of the rocker pivot, and a pair of protrusions upstanding from said rocker spaced on opposite sides on said rocker pivot for respective cooperation with the underside of said base to be selectively squeezed together between compression forces, to abut a complementary pair of abutment elements.

7. A wire connector crimping device according to claim 1, said receivers opening through one side of said base for receiving the connector with said one base side defining a positive stop for engagement with the cut end of wire insulation.

8. A wire connector crimping device according to claim 7, in combination with a flange extending from the other side of said base to prevent obstruction to connectors in said receivers.

9. A wire connector crimping device according to claim 6, each of said protrusions being in general alignment with a respective pair of said abutment elements, for enhancing directness of transmitted compression forces.

* * * * *